US007247981B2

(12) United States Patent
Yamazaki

(10) Patent No.: US 7,247,981 B2
(45) Date of Patent: Jul. 24, 2007

(54) IMAGE FORMING APPARATUS

(75) Inventor: Koji Yamazaki, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 11/280,312

(22) Filed: Nov. 17, 2005

(65) Prior Publication Data

US 2006/0103293 A1 May 18, 2006

(30) Foreign Application Priority Data

Nov. 18, 2004 (JP) ..... 2004-334070
Nov. 2, 2005 (JP) ..... 2005-319129

(51) Int. Cl.
*H01J 1/62* (2006.01)
*H01J 63/04* (2006.01)

(52) U.S. Cl. ..... 313/497; 313/495; 313/292; 313/496; 313/586; 445/24; 345/212

(58) Field of Classification Search ..... 313/483, 313/485, 487, 491–495, 497, 292, 496; 445/24; 315/169.1, 169.3; 345/211–213
See application file for complete search history.

(56) References Cited

U.S. PATENT DOCUMENTS 6,509,691 B2 1/2003 Yamazaki et al. ..... 315/169.3
6,657,368 B1 * 12/2003 Kosaka et al. ..... 313/310
6,705,909 B2 * 3/2004 Nomura et al. ..... 445/24
6,803,715 B1 * 10/2004 Mitsutake et al. ..... 313/495
6,803,717 B2 * 10/2004 Ohnishi ..... 313/495
6,853,148 B2 2/2005 Yamazaki et al. ..... 315/169.3
6,998,769 B2 * 2/2006 Ohnishi ..... 313/495
7,038,371 B2 * 5/2006 Fushimi ..... 313/495
7,053,537 B2 5/2006 Hiroike et al. ..... 313/292
2002/0034916 A1 * 3/2002 Fushimi et al. ..... 445/24
2002/0084997 A1 * 7/2002 Ohnishi ..... 345/211
2005/0007009 A1 * 1/2005 Ohnishi ..... 313/495
2006/0001345 A1 1/2006 Yamazaki ..... 313/292
2006/0103294 A1 5/2006 Suzuki et al. ..... 313/496
2006/0141892 A1 6/2006 Hiroike et al. ..... 445/24

FOREIGN PATENT DOCUMENTS

EP 1 220 273 A3 7/2002
EP 1220273 A2 * 7/2002
JP 2002-237268 8/2002

* cited by examiner

*Primary Examiner*—Jayprakash Gandhi
*Assistant Examiner*—José M. Diaz
(74) *Attorney, Agent, or Firm*—Fitzpatrick, Cella, Harper & Scinto

(57) ABSTRACT

In an image forming apparatus utilizing an electron emitting device, a guard electrode for preventing a creepage discharge from an anode electrode is provided without causing an abnormal discharge with a spacer. A guard electrode positioned at a predetermined distance (x) from a metal back constituting an anode electrode is positioned at such a distance (Lg) from a spacer as not to cause a discharge according to a ratio (x/hs) of the distance x and a height (hs) of a spacer.

4 Claims, 4 Drawing Sheets

IMAGE FORMING APPARATUS

BACKGROUND OF THE INVENTION

1. Field of the Invention

The present invention relates to an image forming apparatus utilizing an electron emitting device.

2. Related Background Art

A larger image size has been desired for image forming apparatuses such as CRT, and a thinner and lighter structure in such large image size is a target for such image forming apparatuses. As an image display apparatus capable of achieving such thinner and lighter structure, the present applicant has proposed an image display apparatus utilizing a surface conduction electron emitting device. Such image display apparatus utilizing the electron emitting device includes a vacuum container formed by sealing a rear plate, provided with plural electron emitting devices, and a face plate, provided with a light emitting member which emits light in response to an electron irradiation and an anode electrode, across a frame member in a peripheral portion.

In such image display apparatus utilizing electron emitting devices, as the luminance of display is proportional to an accelerating voltage, a high accelerating voltage has to be used in order to obtain a high display luminance. Also for realizing a thinner apparatus, a distance between the rear plate and the face plate has to be made smaller. Consequently, a considerably high electric field is generated between these plates, and may induce a discharge between the anode electrode receiving a high potential and other components.

Japanese Patent Application Laid-Open No. 2002-237268 (EP1220273A) discloses a configuration for avoiding a creepage discharge between the anode electrode and another component, by providing a guard electrode outside the anode electrode provided on the surface of the face plate and setting such guard electrode at a potential lower than that of the anode electrode.

In the Japanese Patent Application Laid-Open No. 2002-237268 (EP1220273A), the guard electrode described therein is provided in contact with a spacer for increasing the breakdown voltage, but a secure contact of the guard electrode with the spacer is not easy to achieve and is not favorable in consideration of the productivity. Also in case a small gap is formed between the electrode and the spacer because of an insufficient contact, there may result a discharge between the spacer and the electrode.

SUMMARY OF THE INVENTION

An object of the present invention is to provide an image forming apparatus having a guard electrode not inducing a discharge with a spacer, thus capable of satisfactorily preventing a creepage discharge between an anode electrode and another member thereby resolving the aforementioned drawback and providing a satisfactory productivity.

An image forming apparatus of the present invention includes a cathode substrate having plural electron emitting devices and a cathode electrode, an anode substrate positioned in an opposed relationship to the cathode substrate and having a light emitting member capable of emitting light by an irradiation with electrons emitting from the electron emitting devices, an anode electrode and a guard electrode, a plate-shaped spacer positioned between the cathode electrode and the anode electrode and between the cathode electrode and the guard electrode in contact with the cathode electrode and the anode electrode, and a frame member provided in a peripheral portion of the cathode electrode and the anode electrode and adapted to constitute a vacuum container together with the cathode substrate and the anode substrate:

wherein the guard electrode is positioned between the anode electrode and the frame member, and a distance x [m] between the anode electrode to the guard electrode, a height hs [m] of the spacer, a potential Va [V] of the anode and a gap Lg [m] between the guard electrode and the spacer satisfy a following condition:

$$\text{(in case of } x \le 0.5hs) \quad Lg \ge \frac{\left[-\frac{x}{hs}+0.8\right]Va}{4\times10^8} \tag{1}$$

$$\text{(in case of } 0.5hs < x \le hs) \quad Lg \ge \frac{\left[-0.4\frac{x}{hs}+0.5\right]Va}{4\times10^8} \tag{2}$$

$$\text{(in case of } hs < x) \quad Lg \ge \frac{0.1Va}{4\times10^8} \tag{3}$$

DETAILED DESCRIPTION OF THE PREFERRED EMBODIMENTS

The image forming apparatus of the present invention is a display apparatus utilizing an electron emitting device, and the present invention is advantageously applicable when such display apparatus is constituted utilizing a field emitting electron emitting device or a surface conduction electron emitting device, as a high voltage has to be applied to an anode electrode.

Figure 1:
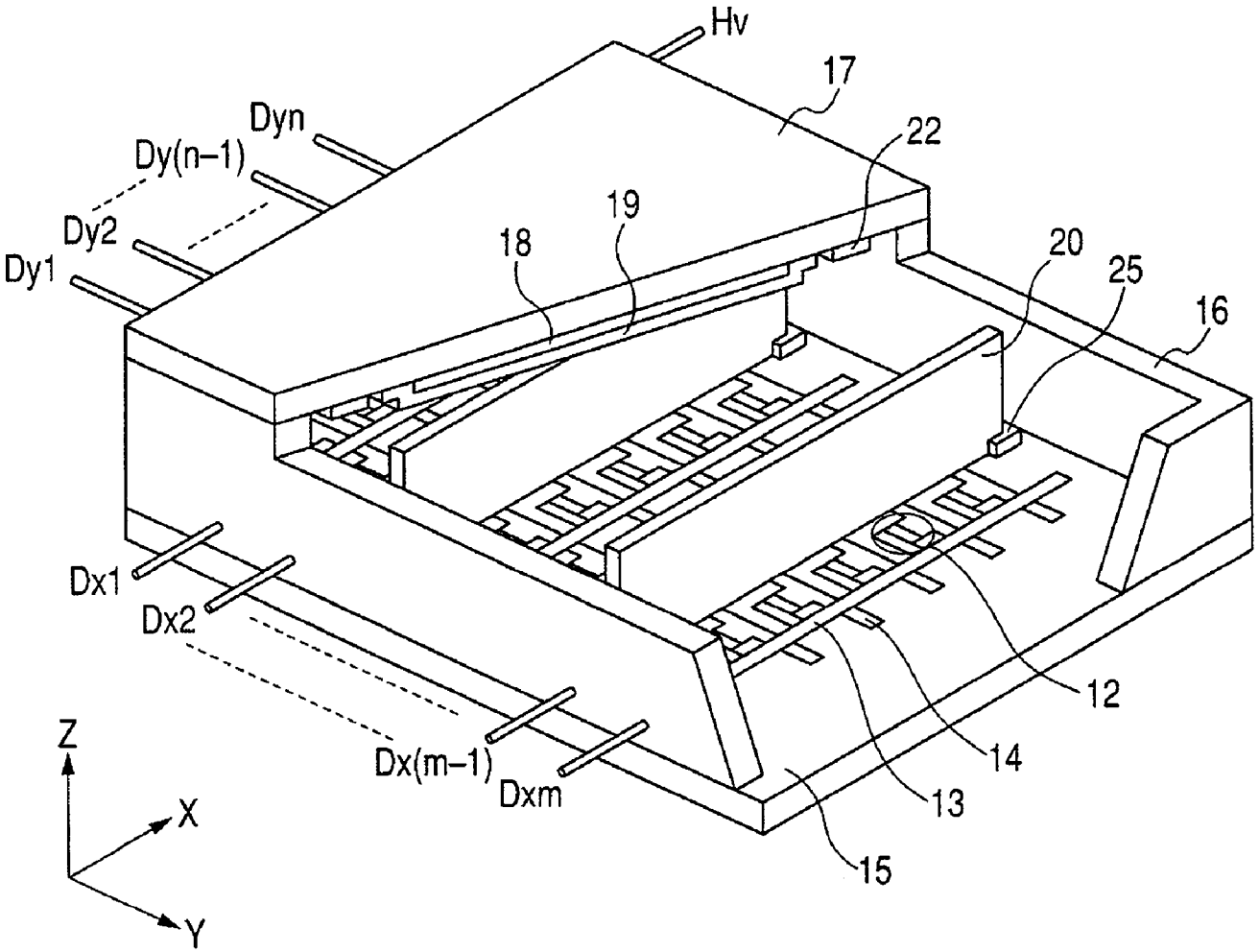
FIG. 1 is a perspective view schematically showing a configuration of a display panel constituting an embodiment of the image display apparatus of the present invention.

FIG. 1 schematically shows a configuration of a display panel embodying the image forming apparatus of the present invention, wherein shown are an electron emitting device 12, a row wiring (cathode electrode) 13, a column wiring 14, a rear plate (cathode substrate) 15, a frame member 16, a face plate (anode substrate) 17, a fluorescent film 18, a metal back (anode electrode) 19, a spacer 20, a guard electrode 22, and a spacer fixing member 25.

In the present invention, the rear plate 15 constituting the cathode substrate and the face plate 17 constituting the anode substrate are sealed at the peripheral portion thereof across the frame member 16, thus constituting a vacuum container. The vacuum container is provided, as the interior thereof being maintained in vacuum state of about $10^{-4}$ Pa, with a spacer 20 of a thin rectangular plate shape as an atmospheric pressure resistant member in order to avoid a damage by the atmospheric pressure or by an unexpected impact. The spacer 20 is fixed, at ends thereof, by the fixing members 25.

The rear plate 15 constituting the cathode substrate is provided thereon with a surface conduction type electron emitting device 12 in N×M units, which are arranged in a simple matrix by M row wirings 13 constituting cathode electrodes and N column wirings 14 (M, N being positive integers). The row wiring 13 and the column wiring 14 are mutually insulated at a crossing point thereof by an unillustrated interlayer insulation film. The present embodiment shows a configuration in which the surface conduction electron emitting devices are arranged in a simple matrix, but the present invention is not limited to such configuration but is applicable advantageously also to other electron emitting devices such as of field emission (FE) type or MIM type, and also is not limited to a simple matrix arrangement.

Figure 4A:
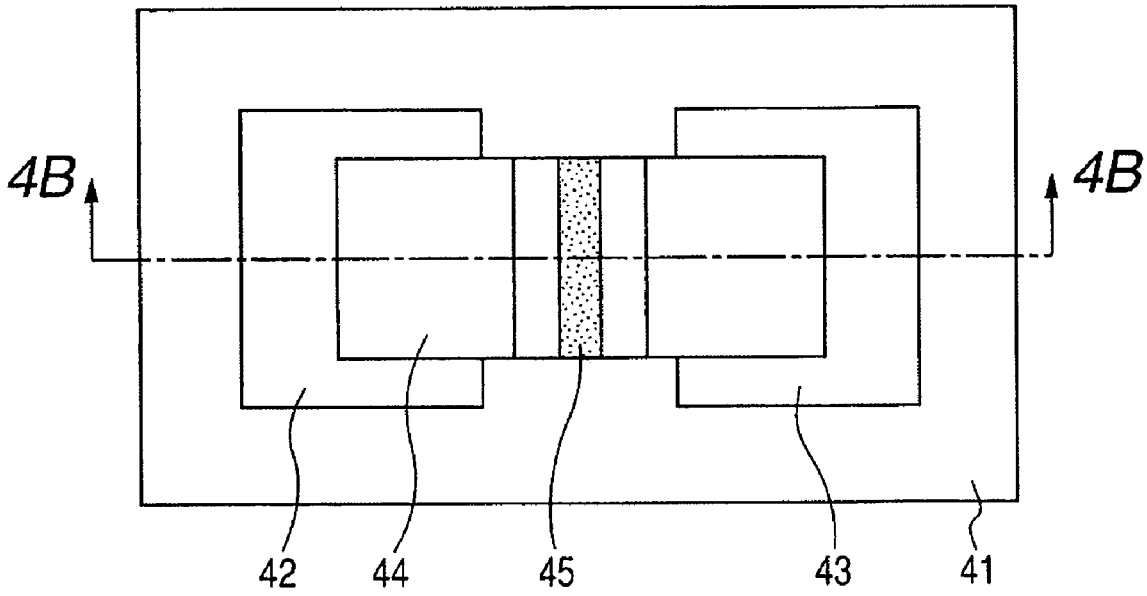
FIGS. 4A and 4B are schematic views showing a basic configuration of a surface conduction electron emitting device employed in the present invention.
Figure 4B:
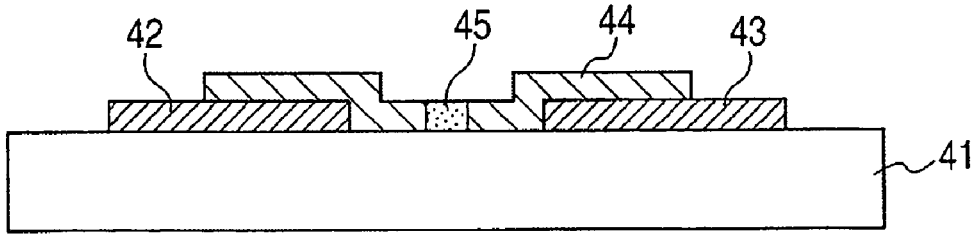

FIGS. 4A and 4B schematically illustrate a basic configuration of a surface conduction electron emitting device to be employed in the present invention. In these drawings, there are shown an insulating substrate 41 corresponding to the rear plate 15 in FIG. 1, device electrodes 42, 43, a conductive film 44 and an electron emitting portion 45 formed by applying a forming voltage to the conductive film 44. FIG. 4A is a plan view, and FIG. 4B is a cross-sectional view along a line 4B-4B in FIG. 4A. In the electron emitting portion 45, a carbon film is usually deposited by an activation process.

Figure 2:
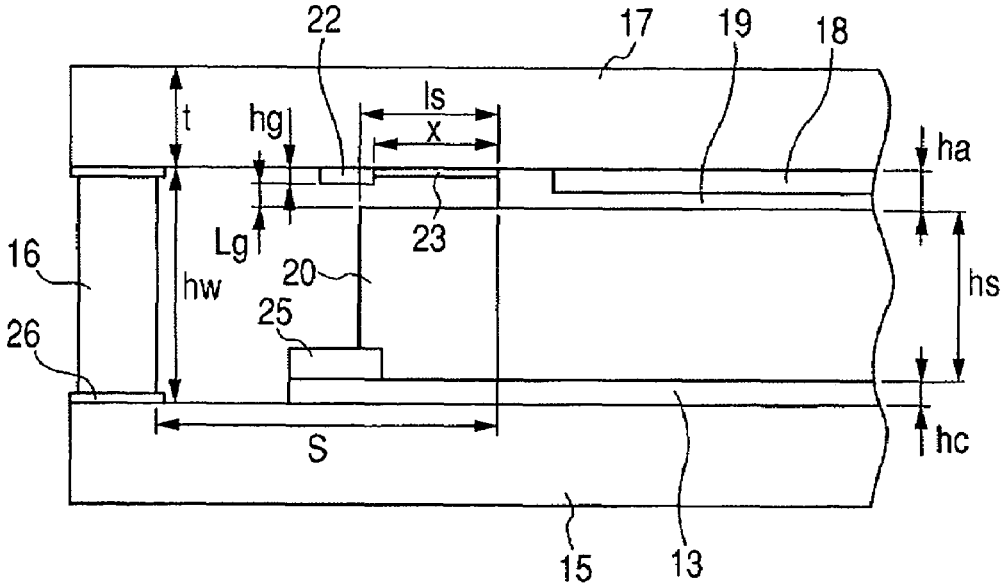
FIG. 2 is a schematic cross-sectional view, along X-direction, of the display panel shown in FIG. 1 in a vicinity of an end portion thereof in X-direction.
Figure 3:
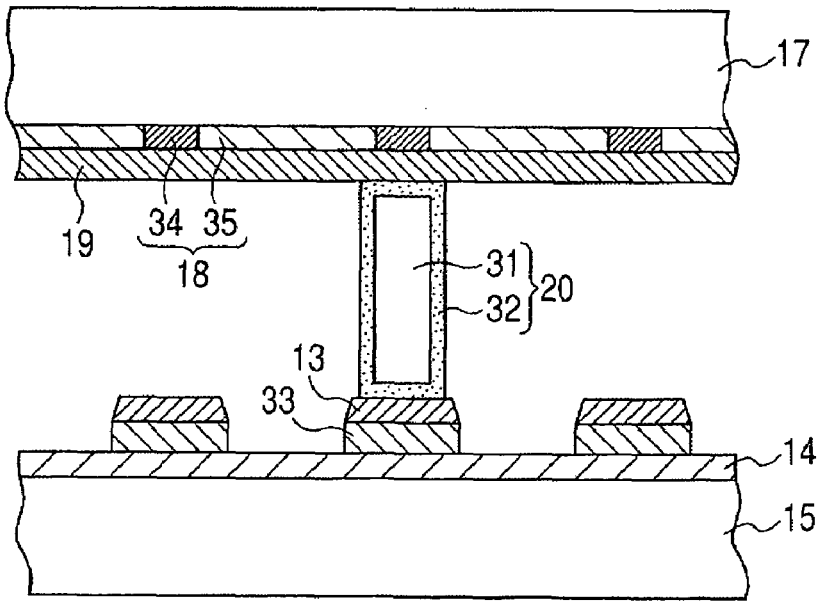
FIG. 3 is a schematic partial cross-sectional view, along Y-direction, of the display panel shown in FIG. 1.

FIG. 2 is a schematic cross-sectional view, along X-direction, of the image forming apparatus shown in FIG. 1 in a vicinity of an end portion thereof in X-direction, and FIG. 3 is a schematic partial cross-sectional view along Y-direction. In the drawings, there are shown a resistance film 23, a fixing member 26, an insulating substrate 31, a high resistance film 32, a black conductive material 34, a phosphor (light emitting member) 35, and an interlayer insulation film 33 for electrical insulation between the column wiring 14 and the row wiring 13. In FIG. 2, the column wiring 14 present between the row wiring 13 and the rear plate 15 and the interlayer insulation layer for electrical insulation between the column wiring 14 and the row wiring 13 are omitted for the purpose of simplicity. The row wiring 13 and the column wiring 14 are also called cathode electrodes. In the configuration shown in FIGS. 2 and 3, a cathode electrode connected to the spacer 20 is the row electrode 13.

In the configuration shown in FIG. 1, the face plate 17 is provided with a phosphor film 18 and a metal back 19 which is already known as an anode electrode in the field of CRT. The phosphor film 18 is divided into phosphors 35 of three primary colors of red, green and blue, for example in a stripe shape as shown in FIG. 3, and a black conductor 34 is provided between the phosphors 35 of respective colors. However, the arrangement of the phosphors 35 is not limited to a stripe shape but may be of other arrangements, such as a delta arrangement, according to the arrangement of the electron sources.

The spacer 20 is usually formed, as shown in FIG. 3, by providing an insulating base member 31 with a high resistance film 32 on the surface thereof principally for preventing electrostatic charging, and is provided in a necessary number with an interval required as an atmospheric pressure resistant member of the display panel. The insulating base member 31 of the spacer 20 can be formed for example by quartz glass, glass with a reduced content of impurities such as sodium, soda lime glass, or ceramics such as alumina, and preferably has a thermal expansion coefficient close to that of the member constituting the vacuum container. Also the high resistance film 32 is preferably formed by WGeN (tungsten germanium nitride).

The spacer 20 to be employed in the present invention has a thin rectangular plate shape, positioned parallel to the row wiring 13 serving as the cathode electrode, and is electrically connected to the row wiring 13 and the metal back 19 serving as the anode electrode.

Now reference is made to FIG. 2 for explaining in detail a configuration around the guard electrode 22 which features the present invention.

In the present invention, as shown in FIG. 2, a guard electrode 22 is provided between the metal back 19 serving as the anode electrode and the frame member 16, with a predetermined distance (x) from the metal back 19. In the configuration shown in FIG. 2, the guard electrode 22 is electrically connected with the metal back 19 through the resistance film 23. The guard electrode 22 is effective for preventing a potential elevation in the peripheral portion in case the anode potential is made higher or in case a peripheral portion of the display panel is made narrower. Also the resistance film 23 is effective for avoiding creepage discharge. The guard electrode 22 is given a ground (GND) potential or a potential sufficiently lower than the anode potential, and the metal back 19 is given the anode potential (Va).

The face plate 17 is sealed to the rear plate 15 constituting the cathode substrate across the frame member 16, which is fixed to each of the face plate 17 and the rear plate 15 by the fixing member 26.

In the present invention, the guard electrode 22 and the spacer 20 are provided in a mutually non-contact manner across a predetermined gap (Lg). As a discharge may be induced under a high Va in case the guard electrode 22 and the spacer 20 are not in contact, they are preferably contacted securely in order to avoid such discharge. However, for achieving such secure contact, there is required a precise control on the heights of the components, thus deteriorating the productivity. In the present invention, therefore, there is provided such a gap Lg that the electrical field therein does not exceed a certain value, thereby reducing the possibility of discharge between the guard electrode 22 and the spacer 20. An upper limit of the electrical field strength, required for suppressing the possibility of discharge between the guard electrode 22 and the spacer 20, is empirically estimated as $4\times10^8$ V/m.

Figure 5:
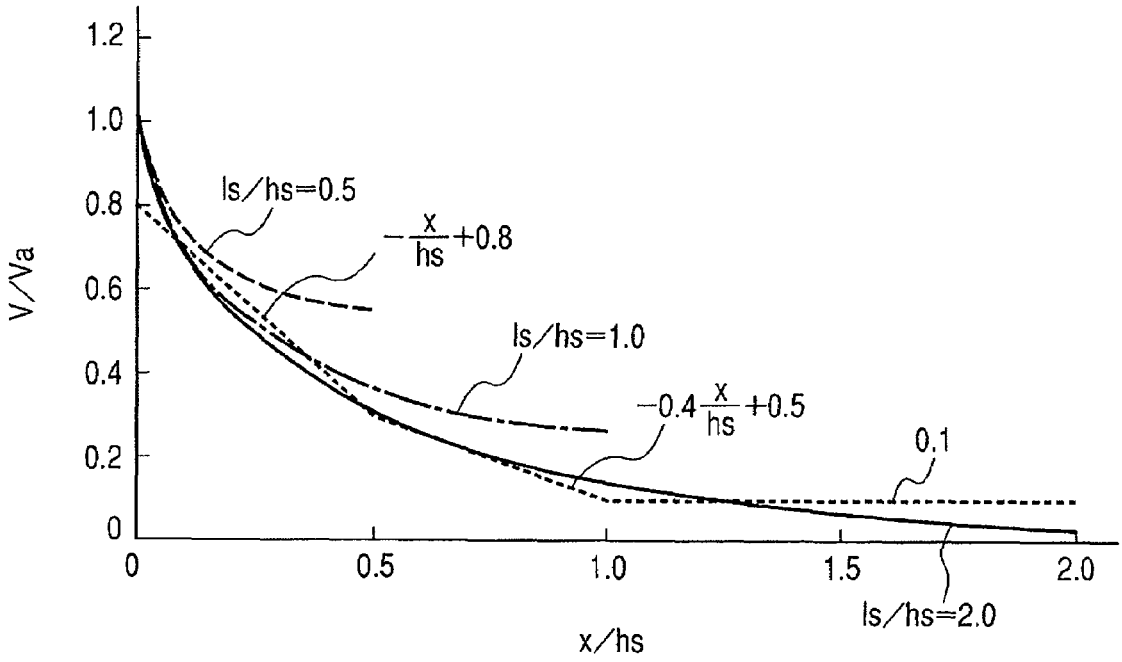
FIG. 5 is a chart showing a potential of a spacer in the present invention in a position corresponding to a guard electrode.

Also a potential of the spacer 20 in a position opposed to the guard electrode 22 can be approximately defined, as shown in FIG. 5, by a ratio (x/hs) of a height (hs [m]) of the spacer 20 and a distance (x [m]) between the metal back 19 and the guard electrode 22. FIG. 5 shows details of the potential for different ratios (Is/hs) of a height (hs [m]) of the spacer 20 and a distance (Is [m]) from a connecting portion of the spacer 20 with the metal back 19 to an end of the spacer. However, the potential in an approximation can be represented by a broken line regardless of the ratio Is/hs. As indicated by the broken line, the potential of the spacer 20 in the position opposed to the guard electrode 22 can be approximately defined, for Va=1 [V], as follows:

$$(\text{for } x \le 0.5hs) \quad -\frac{x}{hs} + 0.8$$

$$(\text{for } 0.5hs < x\ hs) \quad -0.4\frac{x}{hs} + 0.5$$

-continued (for $hs < x$) 0.1

Based on the foregoing, the spacer 20 and the guard electrode 22 preferably have a gap (Lg [m]) satisfying the relationships defined by following equations. It is thus rendered possible to prevent a creepage discharge between the metal back 19 and other components, without inducing a discharge between the spacer 20 and the guard electrode 22:

$$\text{(for } x \le 0.5hs\text{)} \quad Lg \ge \frac{\left[-\frac{x}{hs} + 0.8\right]Va}{4 \times 10^8} \tag{1}$$

$$\text{(for } 0.5hs < x \le hs\text{)} \quad Lg \ge \frac{\left[-0.4\frac{x}{hs} + 0.5\right]Va}{4 \times 10^8} \tag{2}$$

$$\text{(in case of } hs < x\text{)} \quad Lg \ge \frac{0.1Va}{4 \times 10^8} \tag{3}$$

Also in order to attain the aforementioned gap (Lg), the sizes of the components are preferably selected so as to satisfy a following equation (4), among a thickness t [m] of the face plate 17, a height hs [m] of the spacer 20, a height ha [m] from the face plate 17 to the surface of the metal back 19, a height hc [m] from the rear plate 15 to the surface of the row wiring 13, a height hg [m] from the face plate 17 to the surface of the guard electrode 22, a distance (substrate distance) hw [m] between the face plate 17 and the rear plate 15 in the inner vicinity of the frame member 16, a distance S [m] from the frame member 16 to the metal back 19, a Young's modulus E [Pa] of the face plate 17 and an anode potential Va [V]:

$$Lg = (ha - hg) + \frac{x}{S}(hw - hs - hc - ha) - \frac{10^5 S^4}{2Et^3}\left[\frac{x^2}{S^2} - \frac{2x^3}{S^3} + \frac{x^4}{S^4}\right] \tag{4}$$

In the equation (4), the first term on the right-hand side indicates a height difference between the metal back 19 and the guard electrode 22 from the face plate 17. Also the second term on the right-hand side indicates a relative position of the guard electrode that is statically determined by the height of the frame member 16 (thickness within the panel, with a substantially zero thickness for the fixing member 26) and a thickness of the metal back inside the panel. The third term on the right-hand side indicates a bending amount when the atmospheric pressure is applied on the vacuum container.

The aforementioned bending amount of the face plate 17 in case it is formed by a glass substrate, or in case the distance between the metal back 19 and the frame member 16 is made small. In such case, the equation (4) can be simplified as (5), advantageously with fewer constituents. As a specific example, for x=S/2 showing the largest bending, the bending amount becomes 1 μm or less for a case of t=1 mm and S=12 mm, as the glass has a Young's modulus $E \cong 7 \times 10^{10}$ Pa. The bending amount becomes 1 μm or less also in a case of t=2 mm and S=20 mm. The bending amount can also be reduced by selecting a larger t or a condition x<S/2. Lg can be calculated by a following equation (5) generally in case $S^4/t^3$ is 20 (m) or less:

$$Lg = (ha - hg) + \frac{x}{S}(hw - hs - hc - ha) \tag{5}$$

Further, let us consider a situation where a summed height (hs+ha+hc) of the height (hs) of the spacer 20, the height (ha) from the face plate 17 to the surface of the metal back 19 and the height (hc) from the rear plate to the row wiring 13 is approximately equal to the substrate distance (hw) in the vicinity of the frame member 16. Such situation corresponds to a case where the distance from the end of the anode electrode to the frame member is even smaller or the face plate is even thicker. In case $S^4/t^3$ is smaller than 2 (m) in addition to the above-mentioned situation, Lg can be calculated by a following equation (6). In such situation, the gap (Lg) of the guard electrode 22 and the spacer 20 can be advantageously defined solely by the height (ha) from the face plate 17 to the surface of the metal back 19 and the height (hg) from the face plate 17 to the surface of the guard electrode 22:

$$Lg = ha - hg \tag{6}$$

Now, reference is made again to FIG. 1 for explaining other components. In FIG. 1, Dx1–Dxm, Dy1–Dyn and Hv indicate electrical connection terminals of hermetic structure, provided for connecting the display panel with an unillustrated electric circuit. The terminals Dx1–Dxm are electrically connected with the row wirings 13 of the electron source, Dy1–Dyn are connected with the column wirings 14 of the electron source, and Hv is connected with the face plate 17.

In the above-described display panel, electrons are emitted from each electron emitting device by a voltage application thereto through the terminals Dx1–Dxm, Dy1–Dyn provided outside the container. At the same time a high voltage of several kilovolts is applied to the metal back 19 through the terminal Hv outside the container, to accelerate the emitted electrons and to cause the electrons to collide with the internal surface of the face plate 17, whereby the phosphors of respective colors constituting the phosphor film 18 are excited to emit lights, thereby displaying an image.

Usually, a voltage Vf applied to the surface conduction electron emitting device is about 12 to 18 V, a distance between the metal back 19 and the surface conduction electron emitting device is about 0.1 to 8 mm, and a voltage Va between the metal back 19 and the electron emitting device 12 is about 1 to 15 kV.

EXAMPLES

Example 1

An image forming apparatus of a configuration shown in FIGS. 1 to 3 was constructed in the following manner.

As the substrate for the face plate 17, a high distortion point glass (PD200) of a thickness of 3 mm was employed. On such glass substrate, a guard electrode 22 was formed by printing a silver paste, and then a black conductor 34 was formed by printing. In apertures of the black conductor 34, phosphors 35 were formed by a screen printing. Then aluminum was vacuum evaporated thereon as a metal back 19. The thicknesses of the guard electrode, the black conductor and the metal back were determined in consideration of the dimensions of the components as follows. A spacer 20 was formed by sputtering, on a glass base member, a high resistance film 32 of WGeN with a thickness of about 100 nm. A frame member 16 was formed also by glass with a height of 3.6 mm. Between the frame member 16 and the rear plate 15, there was provided a frit glass layer 26 of a thickness of 220 μm. Also between the frame member 16 and the face plate 17, there was provided a frit glass layer 26 of a thickness of 210 μm. The frit glass layer 26 was controlled in thickness by utilizing an unillustrated gap regulating jig at the sealing operation of the face plate, the frame member and the rear plate. More specifically, the thickness of the frit glass layer was controlled by executing the sealing operation in the presence of a gap regulating jig of 4.03 mm between the face plate and the rear plate. As the substrate for the rear plate 15, a high distortion point glass (PD200) of a thickness of 3 mm was employed, as in the face plate. On such glass substrate, there were formed column wirings 14, an interlayer insulation film 22 and row wirings 13. The column wirings 14 and the row wirings 13 were formed by printing a silver paste. These were formed in such a manner that the distance from the surface of the glass substrate to the surface of the row wirings 13 was 10 μm.

In the present example, the components were selected in sizes of t=3 mm, hs=4 mm, Is=8 mm, S=30 mm and x=5 mm for the purpose of preventing unexpected discharge in the peripheral portions along the frame member. Also hw was 4.03 mm because of the aforementioned sizes of the frame member 16 and the frit glass 26. In the present example where hs<x, a condition Lg≧2.5 μm is necessary, based on the equation (3), in order to use Va=10 kV. In the present example, in order to obtain Lg of about 9 μm for a secure breakdown voltage, there were employed a thickness (hg) of 10 μm for the guard electrode 22, a thickness of 20 μm for the black conductor 34 and a thickness of 0.1 μm for the metal back 19.

In such image forming apparatus, a voltage application of Va=10 kV did not cause a discharge between the guard electrode 22 and the spacer 20.

Then the panel was disassembled, and, in a part having a trace in contact with the spacer 20, there were measured the height (ha) from the face plate 17 to the surface of the metal back 19 and the height (hc) from the rear plate 15 to the surface of the row wiring 13. As a result, ha was measured as 20 μm, and the black conductor 34 showed scarce deformation. Also hc was measured as 9 μm, and it was confirmed that a portion of a trace in contact with the spacer 20 was recessed by about 1 μm from other areas. The surface of the guard electrode 22 did not show a contact trace, and the height (hg) from the face plate 17 to the surface of the guard electrode 22 was 10 μm. Therefore, according to the equation (4), Lg =8 μm, satisfying the requirement Lg≧2.5 μm.

Thus the portion of the spacer 20 opposed to the guard electrode 22 had a potential of about 1 kV, with an electric field strength of $1.3\times10^8$ V/m between the guard electrode 22 and the spacer 20, thus preventing the discharge therebetween.

Also a distance between the external surfaces (exposed to the air) of the face plate 17 and the rear plate 15 was measured in different areas, and the thicknesses of the face plate and the rear plate were subtracted from the measured value to calculate a distance between the internal surfaces of the face plate and the rear plate. As a result, the substrate distance corresponding to (hs+hc+ha) was 4.029 mm in the vicinity of the metal back 19 and 4.020 mm in the vicinity of the guard electrode 22. Based on these results and hg, ha, hs, hc etc., Lg was calculated as 9 μm. This value substantially coincides with the Lg calculated from the equation (4).

Example 2

This example was different from the example 1 in that the distance between the frame member and the anode electrode was selected as 20 mm in order to obtain a compacter image display apparatus. Because of this change, the gap (Lg) between the guard electrode 22 and the spacer 20 was calculated as 10 μm from the equation (5). In this example, the portion of the spacer 20 opposed to the guard electrode 22 had a potential of about 1 kV and the row wiring was recessed by about 1 μm as in the example 1, so that the electric field strength between the guard electrode 22 and the spacer 20 was calculated as $1.1\times10^8$ V/m.

Also in the image forming apparatus of the present example, no discharge was observed between the guard electrode 22 and the spacer 20.

Example 3

This example was different from the example 1 in that the distance (S) between the metal back 19 and the frame member 16 was selected as 10 mm and the distance (x) between the metal back 19 and the guard electrode 22 was selected as 2 mm in order to obtain a further compacter image display apparatus, and in that the black conductor 34 was printed in two layers. This provides x≦0.5 hs, so that Lg≧7.5 μm is required from the equation (1), in order to apply Va =10 kV.

In the present example, the sealing operation was conducted by reducing the height of the gap regulating jig by 1 μm, in consideration of a fact that the row wiring was recessed by about 1 μm. More specifically, the gap regulating jig had a height of 4.029 mm. As a result, the height between the rear plate and the face plate in the vicinity of the frame member could be made same as that at the end of the metal back. In the present example, the black conductor 34 was selected as 20 μm and the metal back 19 was selected as 0.1 μm in order to obtain Lg=10 μm. Also the substrate distance (hw) in the vicinity of the frame member 16 was made 4.029 mm by controlling the thickness of the frit glass layer with a gap regulating jig of 4.029 mm as explained above. Then the panel was disassembled, and, in a part having a trace in contact with the spacer 20, there were measured the height (ha) of the metal back 19 from the face plate 17 and the height (hc) of the row wiring 13 from the rear plate 15. As a result, ha was measured as 20 μm, and the black conductor 34 showed scarce deformation. Also hc was measured as 9 μm, and it was confirmed that in the row wiring, a portion of a trace in contact with the spacer 20 was recessed by about 1 μm from other areas. The surface of the guard electrode 22 did not show a contact trace, and the height (hg) from the face plate 17 was 10 μm. Therefore, according to the equation (6), Lg =10 μm, satisfying the requirement Lg≧7.5 μm.

In the present example, the portion of the spacer 20 opposed to the guard electrode 22 had a potential of about 3 kV, with an electric field strength of $3.3\times10^8$ V/m between the guard electrode 22 and the spacer 20.

Also in the image forming apparatus of the present example, no discharge was observed between the guard electrode 22 and the spacer 20.

Example 4

This example was different from the example 3 in employing a thickness (t) of 2 mm for the face plate 17 and a height (hs) of 2 mm for the spacer 20, in order to reduce the panel thickness.

In the present example, in order to obtain Lg of 10 μm, the thickness of the frit glass layer 26 was controlled with a gap regulating jig of 2.03 μm, thereby realizing a substrate distance (hw) of 2.03 mm in the vicinity of the frame member 16. Then the panel was disassembled, and, in a part having a trace in contact with the spacer 20, there were measured the height (ha) of the metal back 19 from the face plate 17 and the height (hc) of the row wiring 13 from the rear plate 15. As a result, ha was measured as 20 μm, matching the summed thickness of the black conductor 34 and the metal back 19. Also hc was measured as 9 μm, and it was confirmed that in the row wiring, a portion of a trace in contact with the spacer 20 was recessed by about 1 μm from other areas. The surface of the guard electrode 22 did not show a contact trace, and Lg was 10 μm according to the equation (6), thus satisfying the requirement Lg≧2.5 μm.

In the present example, the portion of the spacer 20 opposed to the guard electrode 22 had a potential of about 1 kV, with an electric field strength of $1.0\times10^8$ V/m between the guard electrode 22 and the spacer 20.

Also in the image forming apparatus of the present example, no discharge was observed between the guard electrode 22 and the spacer 20.

Comparative Example

This example was different from the example 1 in that the distance (x) between the metal back 19 and the guard electrode 22 was selected as 2.5 mm and in that the guard electrode had a height of 15 μm. This provides 0.5hs<x≦hs, so that Lg≧6.25 μm is required from the equation (2), in order to apply Va =10 kV.

However, in the present example, the gap (Lg) between the guard electrode 22 and the spacer 20 was 4 μm according to the equation (4).

In this image forming apparatus, under gradual increase of Va, a light emission by discharge was observed in the guard electrode 22 at Va=8 kV. In this state, the portion of the spacer 20 opposed to the guard electrode 22 had a potential of about 2 kV, with an electric field strength of $5.0\times10^8$ V/m between the guard electrode 22 and the spacer 20. Thus, in the present example, the gap (Lg) between the guard electrode 22 and the spacer 20 was less than the lower limit defined in the present invention, whereby a high electric field was generated therebetween to induce a discharge.

In the present invention, the guard electrode and the spacer are provided in a mutually non-contact state, and a lower limit is required for such gap. Therefore, the apparatus can be designed within a range capable of meeting such requirement, and can be produced more easily with a significantly higher productivity, in comparison with a configuration in which the guard electrode and the spacer are contacted. Thus the present invention can provide an image display apparatus of a high durability and a high reliability, capable of satisfactorily preventing the discharge between the anode electrode and other components.

This application claims priority from Japanese Patent Application No. 2004-334070 filed on Nov. 18, 2004, which is hereby incorporated by reference herein.

What is claimed is:

1. An image forming apparatus comprising:

a cathode substrate having plural electron emitting devices and a cathode electrode;

an anode substrate positioned in an opposed relationship to said cathode substrate and having a light emitting member capable of emitting light by an irradiation with electrons emitting from said electron emitting devices, an anode electrode and a guard electrode;

a plate-shaped spacer positioned between the cathode electrode and the anode electrode and between the cathode electrode and the guard electrode in contact with the cathode electrode and the anode electrode; and a frame member provided between a peripheral portion of the cathode electrode and the anode electrode and adapted to constitute a vacuum container together with the cathode substrate and the anode substrate:

wherein the guard electrode is positioned between the anode electrode and the frame member, and a distance x [m] between the anode electrode and the guard electrode, a height hs [m] of the spacer, a potential Va [V] of the anode and a gap Lg [m] between the guard electrode and the spacer satisfy a following condition:

$$(\text{for } x \le 0.5hs) \quad Lg \ge \frac{\left[-\frac{x}{hs}+0.8\right]Va}{4\times10^8} \tag{1}$$

$$(\text{for } 0.5hs < x \le hs) \quad Lg \ge \frac{\left[-0.4\frac{x}{hs}+0.5\right]Va}{4\times10^8} \tag{2}$$

$$(\text{for } hs < x) \quad Lg \ge \frac{0.1Va}{4\times10^8}. \tag{3}$$

2. An image forming apparatus according to claim 1, wherein Lg satisfies a relation, among:

a thickness t [m] of the anode substrate, a distance hw [m] between the cathode substrate and the anode substrate in a vicinity of the frame member, a height ha [m] from the anode substrate to the surface of the anode electrode, a height hg [m] from the anode substrate to the surface of the guard electrode, a height hc [m] from the cathode substrate to the surface of the cathode electrode, a distance S [m] from the frame member to the anode electrode, and a Young's modulus E [Pa] of the anode substrate:

$$Lg = (ha - hg) + \frac{x}{S}(hw - hs - hc - ha) - \frac{10^5 S^4}{2Et^3}\left[\frac{x^2}{S^2} - \frac{2x^3}{S^3} + \frac{x^4}{S^4}\right]. \tag{4}$$

3. An image forming apparatus according to claim 1, wherein the anode substrate is formed by a glass substrate; and Lg satisfies a relation, among:

a height hc [m] from the cathode substrate to the surface of the cathode electrode, a distance hw [m] between the cathode substrate and the anode substrate in a vicinity of the frame member, a height ha [m] from the anode substrate to the surface of the anode electrode, a height hg [m] from the anode substrate to the surface of the guard electrode, a height hc [m] from the cathode substrate to the surface of the cathode electrode, and a distance S [m] from the frame member to the anode electrode:

$$Lg = (ha - hg) + \frac{x}{S}(hw - hs - hc - ha). \quad (5)$$

4. An image forming apparatus according to claim 1, wherein the anode substrate is formed by a glass substrate; and Lg satisfies a relation, among:

a height ha [m] from the anode substrate to the surface of the anode electrode, and a height hg [m] from the anode substrate to the surface of the guard electrode:

$$Lg = ha - hg \quad (6).$$

* * * * *